US012364324B2

(12) United States Patent
Van Kempen et al.

(10) Patent No.: US 12,364,324 B2
(45) Date of Patent: Jul. 22, 2025

(54) BRUSH

(71) Applicant: Dyson Technology Limited, Wiltshire (GB)

(72) Inventors: Chris Taylor Van Kempen, Bristol (GB); Robert Mark Brett Coulton, Bristol (GB)

(73) Assignee: Dyson Technology Limited, Malmesbury (GB)

( * ) Notice: Subject to any disclaimer, the term of this patent is extended or adjusted under 35 U.S.C. 154(b) by 283 days.

(21) Appl. No.: 17/922,282

(22) PCT Filed: May 5, 2021

(86) PCT No.: PCT/GB2021/051084
§ 371 (c)(1),
(2) Date: Oct. 28, 2022

(87) PCT Pub. No.: WO2021/234344
PCT Pub. Date: Nov. 25, 2021

(65) Prior Publication Data

US 2023/0172348 A1 Jun. 8, 2023

(30) Foreign Application Priority Data

May 21, 2020 (GB) ..... 2007571

(51) Int. Cl.
*A46B 3/20* (2006.01)

(52) U.S. Cl.
CPC ..... *A46B 3/20* (2013.01); *A46B 2200/104* (2013.01)

(58) Field of Classification Search
CPC ..... A46B 3/20; A46B 3/22; A46B 2200/104
See application file for complete search history.

(56) References Cited

U.S. PATENT DOCUMENTS

| | | | | |
|---|---|---|---|---|
| 2,138,872 A | | 12/1938 | Marogg | |
| 2,482,928 A | * | 9/1949 | Neff | A46B 3/22 15/186 |
| 2,895,487 A | | 7/1959 | Hazzard | |
| 3,739,419 A | | 6/1973 | Natman et al. | |
| 4,112,040 A | | 9/1978 | Orentreich | |
| 5,095,892 A | | 3/1992 | Tsumura | |
| 6,161,245 A | * | 12/2000 | Weihrauch | A46B 7/06 15/201 |

(Continued)

FOREIGN PATENT DOCUMENTS

| | | | |
|---|---|---|---|
| DE | 3927728 | A1 | 2/1991 |
| DE | 19527594 | A1 | 1/1997 |

(Continued)

OTHER PUBLICATIONS

Office Action received for Japanese Patent Application No. 2022-570745, mailed on Jan. 21, 2023, 12 pages (7 pages of English Translation and 5 pages of Original Document).

(Continued)

*Primary Examiner* — Andrew A Horton
(74) *Attorney, Agent, or Firm* — Tucker Ellis LLP

(57) ABSTRACT

A brush is described that includes a body, a carrier, a plurality of bristles and a frame. Each bristle is secured to the carrier and extends through a respective hole in the frame. The carrier deforms in response to pivoting of each bristle, and is held between the body and the frame at each bristle.

18 Claims, 3 Drawing Sheets

(56) References Cited

U.S. PATENT DOCUMENTS

| | | | | |
|---|---|---|---|---|
| 7,690,733 | B2 | 4/2010 | Spitale et al. | |
| 7,975,344 | B2 | 7/2011 | Braun et al. | |
| 8,414,817 | B2 | 4/2013 | Honnefeller et al. | |
| 8,414,818 | B2 | 4/2013 | Honnefeller et al. | |
| 8,469,777 | B2 | 6/2013 | Nagafuchi | |
| 10,512,323 | B2 | 12/2019 | Moskovich et al. | |
| 2005/0055788 | A1 | 3/2005 | Chang et al. | |
| 2008/0052858 | A1 | 3/2008 | Chang et al. | |
| 2009/0000049 | A1 | 1/2009 | Liao | |
| 2010/0299859 | A1 | 12/2010 | Kastl | |
| 2011/0225757 | A1 | 9/2011 | Kuo | |
| 2015/0189979 | A1 | 7/2015 | Stanton | |
| 2015/0216292 | A1 | 8/2015 | Tweel et al. | |
| 2016/0157593 | A1* | 6/2016 | Sze | A46B 3/005 15/160 |
| 2018/0103748 | A1* | 4/2018 | Sze | A46B 9/026 |
| 2023/0180920 | A1 | 6/2023 | Van Kempen | |

FOREIGN PATENT DOCUMENTS

| | | | |
|---|---|---|---|
| EP | 0120299 | A1 | 10/1984 |
| FR | 2331302 | A1 | 6/1977 |
| JP | 62-137072 | A | 6/1987 |
| JP | 02-027852 | Y2 | 7/1990 |
| JP | 03-000312 | Y2 | 1/1991 |
| JP | 03-087320 | U | 9/1991 |
| JP | 07-007526 | U | 2/1995 |
| JP | 2003-225121 | A | 8/2003 |
| JP | 3099422 | U | 4/2004 |
| JP | 3150597 | U | 5/2009 |
| JP | 2010227205 | A | 10/2010 |
| JP | 2012-030133 | A | 2/2012 |
| JP | 2013-240434 | A | 12/2013 |
| JP | 2015-526225 | A | 9/2015 |
| JP | 2016-013190 | A | 1/2016 |
| JP | 2017080191 | A | 5/2017 |
| JP | 3219937 | U | 1/2019 |
| KR | 20160098811 | A | 8/2016 |
| KR | 10-2019-0001435 | U | 6/2019 |
| KR | 10-2055421 | B1 | 12/2019 |
| WO | 2013/172454 | A1 | 11/2013 |
| WO | 2016/162825 | A1 | 10/2016 |

OTHER PUBLICATIONS

Office Action received for Japanese Patent Application No. 2022-570746, mailed on Oct. 31, 2023, 7 pages (4 pages of English Translation and 3 pages of Original Document).

International Search Report and Written Opinion received for PCT Patent Application No. PCT/GB2021/051074, mailed on Jul. 16, 2021, 9 pages.

International Search Report and Written Opinion received for PCT Patent Application No. PCT/GB2021/051084, mailed on Oct. 19, 2022, 9 pages.

Search Report received for GB Application No. 2007571.9, mailed on Nov. 22, 2020, 1 page.

Search Report received for GB Application No. 2007572.7, mailed on Nov. 21, 2020, 1 page.

* cited by examiner

BRUSH

CROSS-REFERENCE TO PRIOR APPLICATION

This application is a § 371 National Stage Application of PCT International Application No. PCT/GB2021/051084 filed May 5, 2021, which claims the priority of United Kingdom Application No. 2007571.9, filed May 21, 2020, each of which are herein incorporated by reference in their entirety.

FIELD OF THE INVENTION

The present invention relates to a brush, particularly but not exclusively a hair brush.

BACKGROUND OF THE INVENTION

A hair brush may comprise bristles secured to a flexible cushion. During use, the cushion flexes so that the bristles better conform to the shape of the user's head, thereby improving comfort. However, the hair brush is generally poor at removing tangles from the hair. In particular, when a bristle encounters a tangle, neighbouring bristles tend to gather at the tangle, making it difficult for the tangle to pass.

SUMMARY OF THE INVENTION

The present invention provides a brush comprising a body, a carrier, a plurality of bristles and a frame, each bristle is secured to the carrier and extends through a respective hole in the frame, the carrier deforms in response to pivoting of each bristle, and the carrier is held between the body and the frame at each bristle.

With the brush of the present invention, the carrier is held between the frame and the body at each bristle. That is to say that the carrier is held at one or more points around each bristle. Accordingly, when a particular bristle pivots and the carrier around that bristle deforms, neighbouring bristles are better isolated from the deformation. Each bristle may therefore move independently of other bristles, i.e. each bristle may move without causing other bristles to move. This then has the advantage that, when the brush is used with hair and a bristle encounters a tangle, the bristle is able to pivot to allow the tangle to pass without neighbouring bristles gathering at the tangle. In contrast, with a conventional hair brush, when a bristle encounters a tangle, the movement of the bristle causes the cushion to flex, which in turn causes neighbouring bristles to gather at the tangle. As a result, it is more difficult for the tangle to pass through the bristles.

The carrier may protrude beyond each hole in the frame. As a result, a larger range of motion may be achieved for each bristle. In particular, by having the carrier protrude beyond each hole, the pivot point for each bristle may be lifted, and deformation of the carrier may be made easier.

Friction between the carrier and the hair may generate static within the hair. Additionally, if the carrier protrudes excessively into the hair, the carrier may trap or catch hair between neighbouring protrusions. Accordingly, the carrier may protrude beyond each hole in the frame by a distance no greater than 5 mm. More particularly, the carrier may protrude beyond each hole in the frame by a distance no greater than 1 mm. This then has the advantage of providing a larger range of motion for the bristles without unduly protruding into the hair of the user.

The brush may comprise a cavity beneath each bristle. For example, the body may comprise a plurality of cavities, and the carrier may be held between the body and the frame such that each bristle sits above a respective cavity in the body. This then has the advantage that, as the tip of each bristle moves, the root of the bristle is free to move into the cavity. By contrast, if no cavity were provided then, as the bristle pivots, the root of the bristle would lift on one side. As a result, the carrier would protrude further into the hair of the user, which may be undesirable for reasons of friction.

The carrier may be held between the frame and the body around each bristle. As a result, when a particular bristle pivots, neighbouring bristles are fully isolated from the deformation of the carrier.

The frame may be hyperbolic paraboloidic in shape. Accordingly, when bristles of identical length are used, the bristles form a bed having an upper profile that is similarly hyperbolic paraboloidic in shape. The bristle bed may be concave in a direction normal to the brushing direction, and convex in a direction parallel to the brushing direction. As a result of the concave shape, the bristles better conform to the shape of the user's head, thereby improving comfort. As the brush is pulled downwards through the hair, a user will tend to roll the brush. Having a convex shape in a direction parallel to the brushing direction encourages hair to penetrate deeper into the bristles, which is of use when a user wishes to generate higher tension in the hair.

The bristles may extend upwardly in directions parallel to one another. As a result, the bristles are better able to tackle tangles. A conventional brush will often have bristles that diverge, i.e. the bristles are splayed. As a result, when a bristle on the leading part of the brush encounters a tangle, the bristle has to move or flex through a greater angle in order for the tangle to pass. This then makes brushing through tangles more difficult. Additionally, bristles on the trailing part of the brush do not penetrate as deeply into the hair. In contrast, by having bristles that all extend in the same direction, bristles at the leading part of the brush move through a smaller angle upon encountering a tangle, making brushing easier. Additionally, bristles on the trailing part of the brush are able to penetrate more deeply into the hair.

The carrier may be formed of an elastomer. More particularly, the carrier may be formed of silicone rubber. Silicone rubber has the advantage that it is relatively inert and is therefore unlikely to cause any adverse reaction with the scalp of a user. Additionally, silicone rubber has a high thermal stability and a good chemical resistance. As a result, the carrier is well-suited for use in a hair brush, which may be subjected to high temperatures during drying of the hair and/or chemicals in the form of hair products.

The carrier may be formed of a material having a Shore A durometer of less than 50. As a result, the carrier is relatively soft permitting a larger range of motion of the bristles.

The carrier may be moulded to the bristles. This then has the advantage that the bristles are better secured to the carrier and are therefore less likely to pop free from the carrier. Additionally, gaps between the bristles and the carrier are less likely to form, which might otherwise trap hair and/or accumulate dirt and other debris.

The carrier may be moulded to the frame. As a result, gaps between the carrier and the frame may be avoided, which again might trap hair and/or accumulate dirt and other debris.

Each bristle may comprise a root and a shaft that extends upwardly from the root, and the shaft may have a diameter of at least 1.2 mm. The diameter of the shaft may be uniform along the length of the shaft. A relatively thick shaft has the advantage that the bristles are stiffer and therefore less likely to be bent or otherwise deformed during use of the brush. Movement of the bristles is then provided by the carrier, which deforms in response to forces acting on the bristles.

Each bristle may comprise a tip formed as a rounded end of the shaft. The bristles of a conventional brush may be relatively narrow with pointed tips. Whilst bristles of this design may be effective at removing tangles, the brush is generally uncomfortable should the bristles contact the scalp. In order to improve comfort, a ball may be provided at the end of the shaft of each bristle. However, whilst this may improve comfort, the ball tends to snag on any tangles. By providing a bristle having a relatively thick shaft and a rounded end, improved comfort may be achieved without any snagging. In particular, when a bristle encounters a tangle, the bristle may pivot rearwards, allowing the tangle to slide off the end of the bristle.

Each bristle may comprise a root and a shaft that extends upwardly from the root. The carrier may surround the root, and the shaft may have a length of at least 15 mm. This then has the advantage that the bristles may penetrate more deeply into hair. By contrast, a brush having shorter bristles may require several passes of the same area of hair. As noted, the bristles of the brush move independently of one another. Consequently, as the bristles increase in length, there is an increased likelihood that neighbouring bristles may clash during use. Accordingly, the shaft may have a length no greater than 22 mm.

Each bristle may have a flexural modulus of at least 1 GPa and/or a flexural stiffness of at least 500 N/m. As a result, the bristles are less likely to be bent or otherwise deformed during use of the brush. Additionally, being relatively stiff, the bristles are more likely to pivot at the roots, which better encourages tangles to slip from the bristles. By contrast, the bristles of a conventional brush may have a much lower flexural modulus and stiffness. Rather than pivoting, the bristles bend or flex during use. However, the bristles are more likely to be damaged due to flexing beyond the elastic limit or fatigue from the repeated flexing of the bristles. Additionally, tangles caught deep within the bristles are more likely to become trapped. The bristles may be formed of metal, such as stainless steel or aluminium. The bristles are therefore relatively strong, tough and hard and are less likely to be damaged during use or in the event that the brush is dropped inadvertently.

The bristles may be arranged in rows and the bristles in each row may be staggered relative to bristles in adjacent rows. Moreover, the bristles may have a pitch perpendicular to a brushing direction of the brush of between 5 and 8 mm, and a pitch parallel to the brushing direction of between 10 and 16 mm. Having a smaller pitch perpendicular to the brushing direction allows for better alignment of the hair. Additionally, fewer passes are typically required to detangle hair. Having a larger pitch parallel to the brushing direction, on the other hand, allows for a larger range of bristle movement without clashing of the bristles.

The present invention also provides a brush comprising a carrier, a plurality of bristles and a frame, wherein the carrier is moulded to the bristles and the frame, each bristle extends through a respective hole in the frame, and the carrier deforms in response to pivoting of each bristle.

BRIEF DESCRIPTION OF THE DRAWINGS

Embodiments will now be described, by way of example, with reference to the accompanying drawings in which.

DETAILED DESCRIPTION OF THE INVENTION

Figure 1:
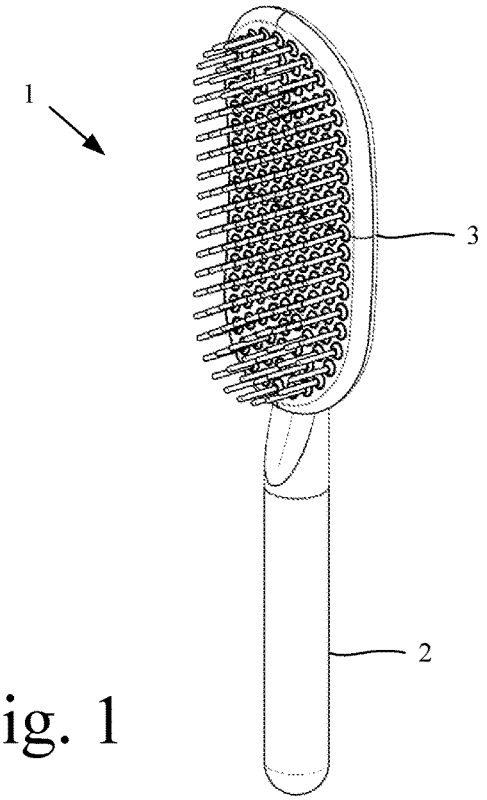
FIG. 1 illustrates a brush in accordance with a first embodiment.
Figure 2:
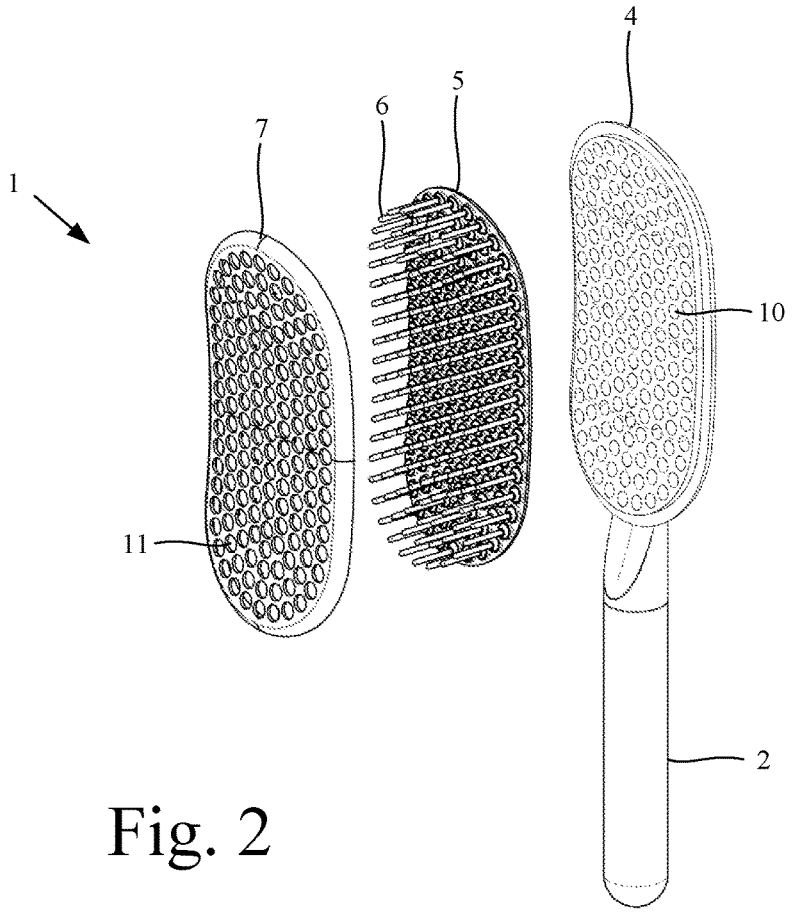
FIG. 2 is an exploded view of the brush.
Figure 3:
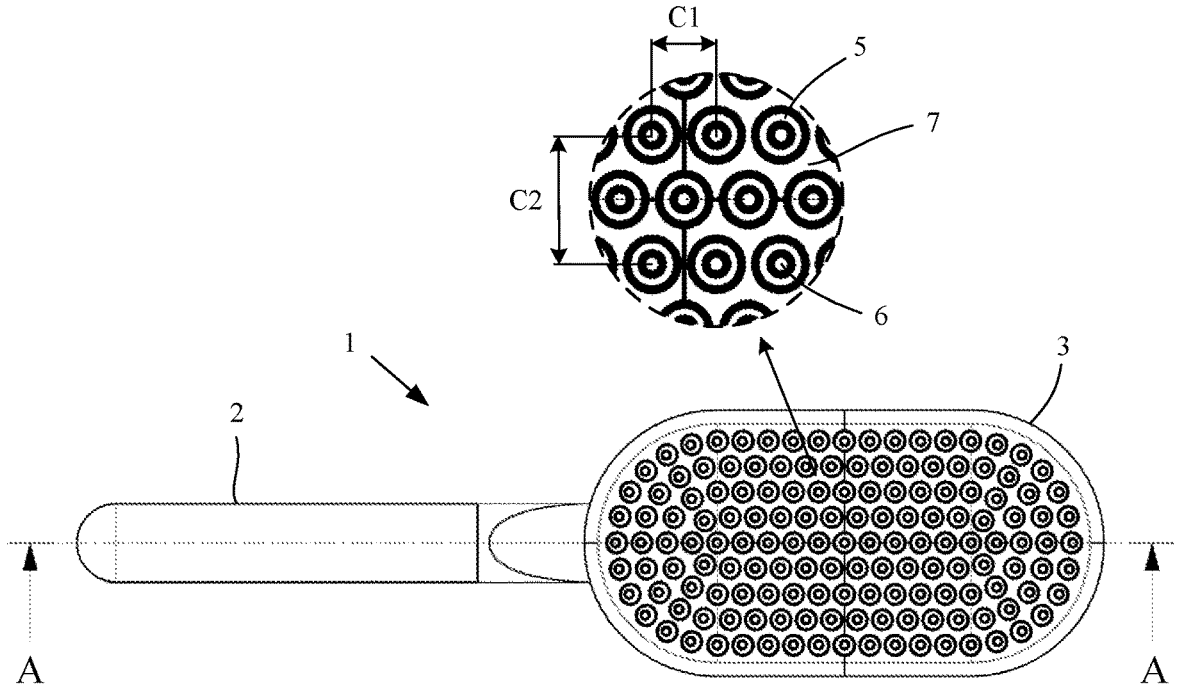
FIG. 3 is a plan view of the brush.
Figure 4:
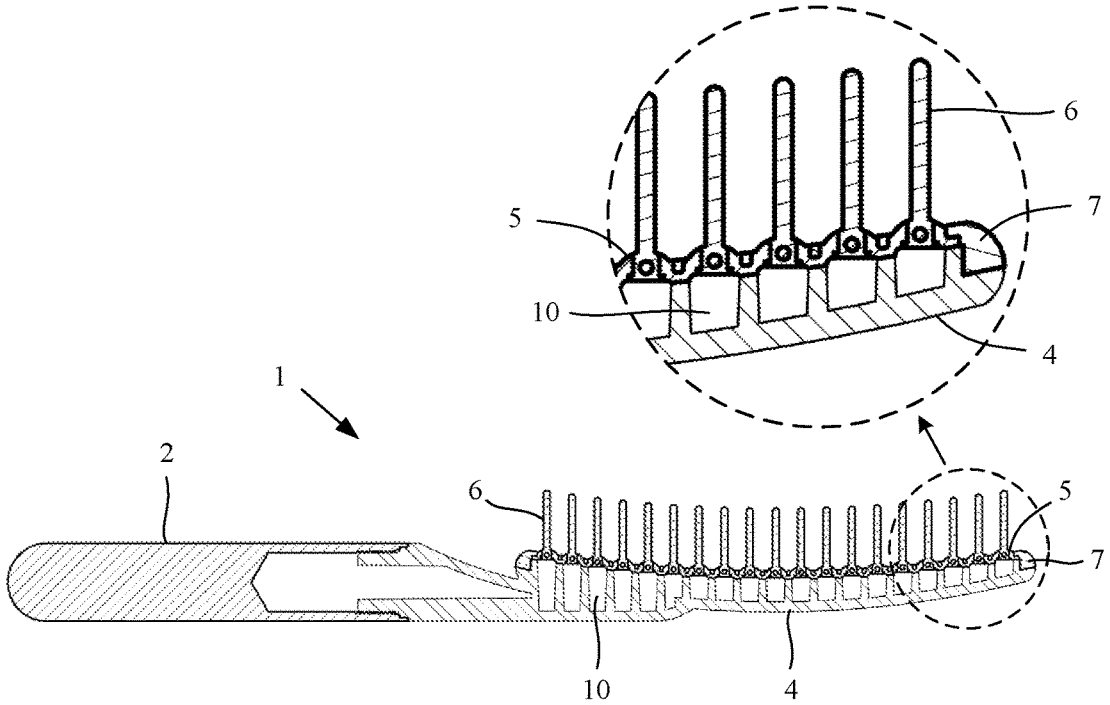
FIG. 4 is a section through the brush, taken along the line A-A of FIG. 3.
Figure 5:
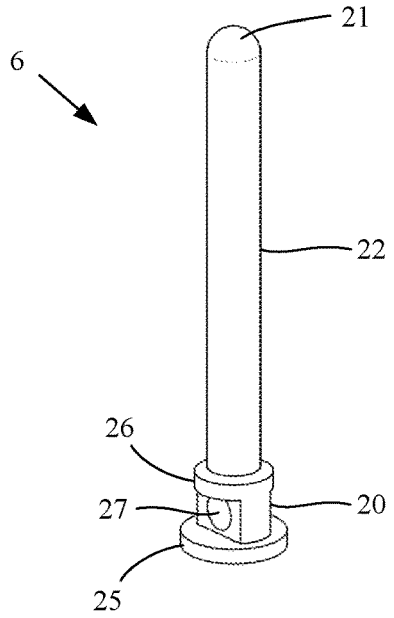
FIG. 5 illustrates a bristle forming part of the brush.

The brush 1 of FIGS. 1 to 5 comprises a handle 2 attached a head 3. The head 3 comprises a body 4, a carrier 5, a plurality of bristles 6, and a frame 7.

The body 4 is formed of a rigid material, such as a thermoplastic, and comprises a plurality of cylindrical cavities 10 formed in an upper surface of the body 4.

The carrier 5 is formed of a silicone rubber having a Shore A durometer of around 20 to 30.

Each of the bristles 6 comprises a root 20, a tip 21 and a shaft 22 that extends from the root 20 to the tip 21. The root 20 comprises a base 25, a stem 26 that extends upwardly from the base 25, and a through-hole 27 formed in the stem 26. The base 25 extends radially outwardly beyond the stem 26, and the stem 26 extends radially outward beyond the shaft 22. The shaft 22 of each bristle has a length of 17 mm and a diameter of 1.7 mm. Additionally, each bristle 6 is formed of stainless steel. As a consequence, each bristle 6 is relatively stiff and has a flexural modulus of around 193 GPa and a flexural stiffness of around 48 kN/m. The flexural stiffness (also referred to flexural rigidity or bending stiffness) is measured as a cantilevered deflection of the tip 21 of the bristle 6 when fixed at the root 20.

Each of the bristles 6 is secured to the carrier 5. More particularly, the carrier 5 is moulded to the root 20 of each bristle 6 such that the shaft 22 extends proud of the carrier 5.

The frame 7 is formed of a rigid material, such as a thermoplastic, and comprises a plurality of holes 11. The frame is hyperbolic paraboloidic in shape. More particularly, the frame 7 is concave along the length of the head 3 (i.e. perpendicular to the brushing direction) and convex along the width of the head 3 (i.e. parallel to the brushing direction). The frame 7 is secured to the body 4 at one or more points around the periphery of the frame 7, e.g. by snap fit, adhesive or ultrasonic welding.

The carrier 5 is held between the body 4 and the frame 7, with each bristle 6 extending through a respective hole 11 in the frame 7. The carrier 5 is held between the body 4 and the frame 7 such that each bristle 6 sits above a cavity 10 in the body 4. Moreover, the carrier 5 is held between the body 4 and the frame 7 around each bristle 6.

In response to pivoting of a bristle 6, the carrier 5 at the root 20 of the bristle 6 deforms. Since the carrier 5 is held between the body 4 and the frame 7 around each bristle 6, neighbouring bristles 6 are isolated from the deformation of the carrier. That is to say that, the deformation of the carrier 5 around the root of one bristle does not cause the carrier 5 around the roots of neighbouring bristles to deform or otherwise move. Each bristle 6 therefore behaves as if secured to an individual elastomer bead. In particular, each bristle 6 may pivot independently of all other bristles.

The carrier 5 protrudes upwardly beyond each hole 11 in the frame 7. More particularly, the carrier 5 may be regarded as comprising a plurality of dome-shaped protrusions, each of which protrudes beyond a respective hole 11 in the frame 7. By having the carrier 5 protrude beyond each hole 11, the pivot point for each bristle 6 is lifted upwards. Additionally, deformation of the carrier 5 is made easier. As a result, a larger range of motion may be achieved for each of the bristles 6.

The bristles 6 extend upwardly from the carrier 5 and the frame 7 in directions that are parallel to one another. As a result, the bristles 6 neither diverge nor converge. The majority of the bristles 6, particularly those forming a central region, are arranged in rows along the length of the head 3, with the bristles 6 in each row being staggered relative to bristles 6 in adjacent rows. The bristles 6 have a pitch, C1, along the length of the head (i.e. perpendicular to the brushing direction) of 6.5 mm, and a pitch, C2, along the width of the head (i.e. parallel to the brushing direction) of 13 mm.

During use of the brush 1, the bristles 6 penetrate the hair of a user. As the brush 1 is pulled downwards through the hair, the bristles 6 pivot slightly rearwards. The bristles 6 are relatively stiff and any movement of the bristles 6 occurs via deformation of the carrier 5. When a bristle 6 encounters a tangle in the hair, the bristle 6 will pivot further rearwards as the brush 1 continues to be pulled downward. The force applied by the bristle 6 to the tangle therefore increases. If the tangle is particularly difficult and the force applied by the bristle 6 is not sufficient to part the tangle, the bristle 6 will eventually pivot to a point at which the tangle slips from the bristle 6. As a result, the brush 1 may be pulled through the hair without causing significant discomfort to the user. The brush 1 may then be used in a subsequent pass through the hair, with each pass parting more of the tangle. Importantly, with each pass of the brush 1, the bristles 6 continue to pivot rearwards and will allow the tangle to pass should the force become excessive. As a result, discomfort due to bristles pulling at a tangle may be avoided.

Each bristle 6 pivots independently of the other bristles. This then has the advantage that, when a bristle encounters a tangle, the bristle is able to pivot to allow the tangle to pass without neighbouring bristles gathering at the tangle. In contrast, with a conventional hair brush, when a bristle encounters a tangle and pivots rearward, the movement of the bristle causes the cushion to flex, which in turn causes neighbouring bristles to gather at the tangle. As a result, it is more difficult for the tangle to pass through the bristles.

The frame 7 is hyperbolic paraboloidic in shape. The bristles 6, which are of identical length, form a bed having an upper profile that is similarly hyperbolic paraboloidic in shape. The bristle bed is concave along the length of the head, i.e. in a direction perpendicular to the brushing direction, and convex along the width of the head, i.e. in a direction parallel to the brushing direction. As a result of the concave shape, the bristles 6 better conform to the shape of the user's head, thereby improving comfort. As the brush 1 is pulled downwards through the hair, a user will tend to roll their wrist and therefore the brush 1. Having a convex shape in a direction parallel to the brushing direction encourages hair to penetrate deeper into the bristles 6, which is of use when a user wishes to generate higher tension in the hair.

The majority of the bristles 6 have pitches C1 and C2 of 6.5 mm and 13.0 mm respectively. The bristles 6 therefore have a smaller pitch perpendicular to the brushing direction. As a result, good alignment of the hair may be achieved. That is to say that the bristles capture and straighten more of the hair strands. In contrast, if a larger pitch were employed, more of the hair would pass between the bristles and maintain its original, chaotic orientation. A smaller pitch perpendicular to the brushing direction has the further advantage that fewer passes are typically required to detangle the hair owing to the higher bristle count. Having a larger pitch parallel to the brushing direction, on the other hand, allows for a larger range of bristle movement without clashing of the bristles. If a smaller pitch were used then, when a particular bristle encounters a tangle and pivots rearwards, the bristle may clash with the neighbouring bristle directly behind it. The neighbouring bristle may then hinder the tangle from slipping off the bristle. Alternative pitches for the bristles 6 are, of course, possible. However, staggered bristles having a perpendicular pitch C1 of between 5 mm and 8 mm and a parallel pitch C2 of between 10 mm and 16 mm have been found to provide a good balance between the desire to provide a high bristle count to improve brushing effectiveness, and the desire to avoid clashing of bristles to improve comfort.

The bristles 6 extend upwardly in directions parallel to one another. As a result, the bristles 6 are better able to tackle tangles and penetrate the hair. A conventional brush will often have bristles that are splayed. As a result, when a bristle on the leading part of the brush encounters a tangle, the bristle has to pivot or flex through a greater angle in order for the tangle to pass. This then makes brushing through tangles more difficult. Additionally, bristles on the trailing part of the brush do not penetrate as deeply into the hair. In contrast, by having bristles 6 that extend in the same direction (i.e. bristles that neither diverge nor converge), the bristles 6 at the leading part of the brush 1 move through a smaller angle upon encountering a tangle, whilst the bristles 6 on the trailing part of the brush 1 are able to penetrate more deeply into the hair.

Each bristle 6 has a flexural modulus of around 193 GPa and a flexural stiffness of around 48 kN/m. As a result, the bristles 6 are less likely to be bent or otherwise deformed during use of the brush 1. Additionally, being relatively stiff, the bristles 6 are more likely to pivot at the roots, which better encourages tangles to slip from the bristles 6. By contrast, the bristles of a conventional brush may have a much lower flexural stiffness. Rather than pivoting, the bristles flex or bend during normal use. However, bristles of this type are more likely to be damaged due to flexing beyond the elastic limit or fatigue from the repeated flexing of the bristles. Additionally, tangles caught deep within the bristles are more likely to become trapped.

The bristles 6 of the brush 1 are formed of stainless steel, which further reduces the likelihood of damage, particularly when the bristles 6 are subjected to high temperatures during drying or chemicals from hair products. Additionally, the surface of the bristles 6 may be polished in order to reduce friction, which then helps reduce static within the hair.

In spite of the aforementioned advantages, bristles of alternative materials and/or flexural modulus and stiffness may be used. In particular, the bristles may be formed of other metals, such as aluminium, which continue to provide relatively high flexural modulus and stiffness. Alternatively, the bristles may be formed of glass-reinforced nylon, which sits relatively close to human hair on the triboelectric series. As the flexural modulus and stiffness of the bristles decrease, the aforementioned advantages diminish. Accordingly, the bristles may have a flexural modulus of at least 1 GPa and/or a flexural stiffness of at least 500 N/m.

The shaft 22 of each bristle 6 is 1.7 mm in diameter. Additionally, the diameter of each bristle 6 is uniform along the length of the shaft 22. This relatively large diameter is partly responsible for achieving the relatively high flexural stiffness of the bristle 6. However, bristles 6 having a relatively large diameter has further advantages. In particular, the tip 21 of the bristle 6 may be formed as a rounded end of the shaft 22. The bristles of a conventional brush may be relatively narrow with pointed tips. Whilst bristles of this type may be relatively effective at removing tangles, the brush is generally uncomfortable should the bristles contact the scalp. In order to improve comfort, a ball may be provided at the end of the shaft of each bristle. However, although this may improve comfort, the ball tends to snag on any tangles. In contrast, by having bristles 6 that comprise a relatively thick shaft and which have ends that are rounded, improved comfort may be achieved without any snagging. Bristles having an alternative diameter, which may be uniform or tapered, may be used. However, by employing bristles that have a shaft diameter of at least 1.2 mm at the tip, relative comfort may be achieved without the need for a ball or other feature that might snag on the hair.

The shaft 22 of each bristle 6 has a length of 17 mm. As a result, good penetration of the bristles 6 into the hair may be achieved, and thus fewer passes of the brush 1 through the hair are required. Again, bristles 6 having an alternative shaft length may be used. However, as the length of the shaft 22 decreases, penetration of the bristle 6 into the hair decreases. Accordingly, the shaft 22 of each bristle 6 may have a length of at least 15 mm. As the length of the shaft 22 increases, there is an increased likelihood that neighbouring bristles may clash during use. In particular, when a bristle encounters a tangle and pivots rearwards, the bristle may clash with a neighbouring bristle directly behind it if the bristles are excessively long; this will depend on the pitch of the bristles 6 as well as the length of the bristles 6. However, for the pitches described above, the shaft of each bristle 6 may have a length no greater than 22 mm.

The carrier 5 protrudes upwardly beyond each hole 11 in the frame 7 which, as noted above, promotes a larger range of movement for the bristles 6. In the embodiments illustrated in FIGS. 4 and 6, the carrier 5 protrudes beyond the frame 7 by 0.85 mm and 5 mm respectively. As a consequence of protruding beyond the frame 7, the carrier 5 will inevitably contact the hair. Friction between the carrier 5 and the hair may generate static. Additionally, if the carrier 5 were to protrude excessively beyond the frame 7, the carrier 5 may drag at the hair or worse, the carrier 5 may trap or catch hair between neighbouring protrusions. Accordingly, the carrier 5 may protrude beyond each hole 11 in the frame 7 by a distance no greater than 5 mm. More particularly, the carrier 5 may protrude beyond each hole 11 in the frame 7 by a distance no greater than 1 mm. This then has the advantage of providing a larger range of motion for the bristles 6 without adversely dragging or trapping the hair.

The carrier 5 is formed of silicone rubber. Silicone rubber is relatively inert and is therefore unlikely to cause any adverse reaction with the scalp of a user. Additionally, silicone rubber has a high thermal stability and a good chemical resistance. As a result, the carrier 5 is well-suited for use in a hair brush, which may be subjected to high temperatures during drying of the hair and/or chemicals in the form of hair products. However, silicone rubber is not without its disadvantages. For example, silicon rubber is relatively expensive and, owing to its inertness, can be difficult to bond to the bristles. Accordingly, alternative materials, and in particular alternative elastomers, may be used for the carrier 5.

The carrier 5 is formed of a relatively soft material having a Shore A durometer of around 20 to 30. As a result, a relatively large range of motion is achieved for the bristles 6. A material having a different Shore A durometer may nevertheless be used, and a good range of motion may still be achieved with a material having a Shore A durometer of less than 50.

The brush 1 comprises a cavity 10 is located beneath each bristle 6. This then has the advantage that, as each bristle 6 pivots, the root 20 of the bristle 6 is free to move into the cavity 10. By contrast, if no cavity were provided then, as the bristle 6 pivots, the root 20 of the bristle 6 would lift upwards on one side. The carrier 5 would then protrude further into the hair, which may be undesirable for reasons set out above.

The carrier 5 is moulded to the bristles 6. This then has the advantage that the bristles 6 are better secured to the carrier 5 and are therefore less likely to pop free from the carrier 5 during use. This is particularly true when the carrier 5 is formed of a soft and inert material, such as silicone rubber. A further advantage of moulding the carrier 5 to the bristles 6 is that gaps, which may trap hair and/or accumulate dirt and other debris, are less likely to form between the carrier 5 and the bristles 6. The carrier 5 may also be moulded to the frame 7. As a result, gaps between the carrier 5 and the frame 7 may be avoided, which again might trap hair and/or accumulate dirt and other debris.

The carrier 5 is formed of a relatively soft material. As a result, even when the carrier 5 is moulded to the bristles 6, a bristle could potentially pop free if the bristle pivots excessively. The bristles 6 therefore comprise features that better anchor the bristles 6 to the carrier 5. Each bristle 6 comprises a through-hole 27 into which the carrier 5 projects. As a result, each bristle 6 is better secured to the carrier 5. In particular, a bristle 6 is capable of popping free only if the portion of carrier 5 that extends through the hole 27 fails. The root 20 of each bristle 6 comprises a base 25 that extends outwardly beyond a stem 26. The base 25 therefore presents a surface (e.g. an annulus) that opposes upward movement of the bristle 6 relative to the carrier 5. As a result, it is more difficult to pull a bristle 6 free from the carrier 5. The stem 26 comprises an undercut and thus presents a surface which opposes downward movement of the bristle 6 relative to the carrier. The diameter of the through-hole 27 is relatively small. As a result, the portion of the carrier 5 that projects into the through-hole 27 forms a relatively thin thread. The through-hole 27 is formed in the undercut of the stem 26. Consequently, the length of the through-hole 27 and thus the length of the thread of the carrier 5 is shortened. As a result, the portion of the carrier 5 that extends through the hole 27 is more robust and less likely to fail.

Although each bristle 6 comprises a single through-hole 27, conceivably the bristle 6 may comprise a pair of holes arranged orthogonally. This may result in a better securement of the bristles 6 to the carrier 7. A single through-hole may influence the way in which the bristle pivots. In particular, it may be easier to pivot the bristle in directions normal to the hole and harder in directions parallel to the hole. In this instance, the provision of two orthogonal holes may lead to more uniform motion of the bristles.

The frame 7, although formed of a rigid material, is relatively thin and has a large open area. As a result, the frame 7 is relatively pliant. The base 4 is therefore required to provide structural strength to the brush 1. However, if the frame 7 were stiffer (e.g. thicker), the base 4 might conceivably be omitted. The carrier 5 would then be moulded or otherwise bonded to the frame 7. By bonding to the carrier 5 to the frame 7 around each bristle 6, the brush 1 would continue to have the benefits described above. In particular, each bristle 6 would continue to pivot independently of the other bristles.

Figure 6:
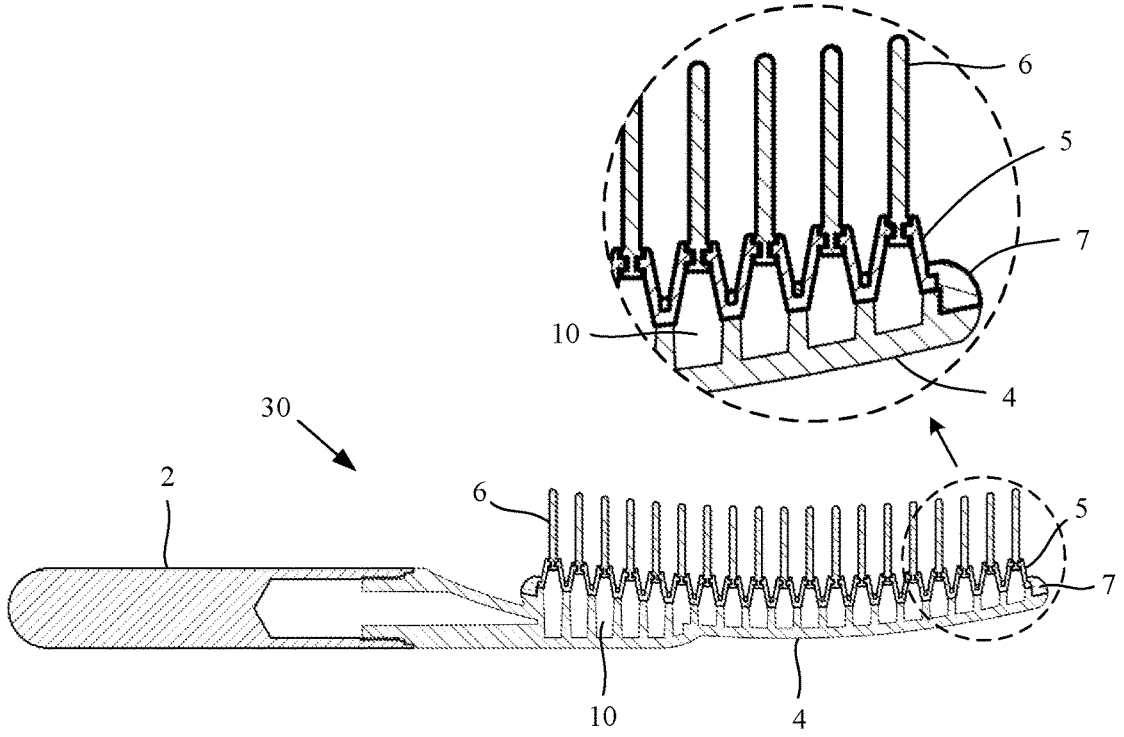
FIG. 6 is a section through a brush in accordance with a second embodiment.

FIG. 6 illustrates an alternative brush 30 which is identical in many respects to the brush 1 of FIGS. 1 to 5. However, the carrier 5 of the brush 30 has a different profile. In particular, the carrier 5 protrudes further beyond each hole in the frame 7. Rather than the relative shallow protrusions seen in FIG. 4, the carrier 5 may comprises a plurality of conical protrusions that extend upwardly beyond each hole. The protrusions resemble the elastomer nozzles that can be found on some shower heads. Each bristle 6 is then secured at the apex of each protrusion. The carrier 5 continues to be held between the body 4 and the frame 7, and thus each bristle 6 continues to pivot independently of the other bristles.

With the brush 1 of FIGS. 1 to 5, as a bristle 6 pivots, the carrier 5 surrounding the bristle 6 is compressed and stretched. As a result, a relatively soft material is required in order to achieve a large range of movement for the bristles 6. With the brush 30 of FIG. 6, as a bristle 6 pivots, the carrier 5 bends or folds at the protrusion. The same range of movement of the bristles 6 may therefore be achieved using a harder material for the carrier 5.

The bristles 6 may be secured to the carrier 5 in the same way as that described above for the brush of FIGS. 1 to 5. In particular, the carrier 5 may be moulded to the bristles 6, and each bristle 6 may comprise a through-hole 27 into which the carrier 5 projects. By using a harder material for the carrier 5, the bristles 6 are less likely to pop free during use. Indeed, a good securement of the bristles 6 to the carrier 5 may be achieved without the need to provide a through-hole 27 in the bristle 6.

By using a harder material for the carrier 5, the bristles 6 may be secured to the carrier 5 in alternative ways. For example, each of the bristles 6 may be pushed through the carrier 5. This then simplifies the manufacture of the brush 30.

Whilst particular embodiments have thus far been described, it will be understood that various modifications may be made without departing from the scope of the invention as defined by the claims. For example, although the brush described herein is a hair brush, many of the features may be used with alternative types of brush.

The invention claimed is:

1. A brush comprising:
a body;
a carrier;
a plurality of bristles; and
a frame,
wherein each bristle is secured to the carrier and extends through a respective hole in the frame,
wherein the carrier deforms in response to pivoting of each bristle and the carrier is held between the body and the frame at one or more points around each bristle, whereby each bristle is movable independent of movement of other bristles of the plurality of bristles.

2. The brush as claimed in claim 1, wherein the carrier protrudes upwardly beyond each hole in the frame.

3. The brush as claimed in claim 2, wherein the carrier protrudes upwardly beyond each hole in the frame by a distance no greater than 5 mm.

4. The brush as claimed in claim 1, wherein the brush comprises a cavity beneath each bristle.

5. The brush as claimed in claim 1, wherein portions of the carrier surrounding each bristle are held between the frame and the body around each bristle.

6. The brush as claimed in claim 1, wherein the frame is hyperbolic paraboloidic in shape.

7. The brush as claimed in claim 1, wherein the bristles extend parallel to one another.

8. The brush as claimed in claim 1, wherein the carrier is formed of silicone rubber.

9. The brush as claimed in claim 1, wherein the carrier is formed of a material having a Shore A durometer of less than 50.

10. The brush as claimed in claim 1, wherein the carrier is moulded to the bristles.

11. The brush as claimed in claim 1, wherein the carrier is moulded to the frame.

12. The brush as claimed in claim 1, wherein each bristle comprises a root and a shaft that extends upwardly from the root, and the shaft has a diameter of at least 1.2 mm.

13. The brush as claimed in claim 12, wherein each bristle comprises a tip formed as a rounded end of the shaft.

14. The brush as claimed in claim 1, wherein each bristle comprises a root and a shaft that extends upwardly from the root, the carrier surrounds the root, and the shaft has a length of at least 15 mm.

15. The brush as claimed in claim 1, wherein each bristle has a flexural modulus of at least 1 GPa or a flexural stiffness of at least 500 N/m.

16. The brush as claimed in claim 1, wherein the bristles are formed of metal.

17. The brush as claimed in claim 1, wherein the bristles are arranged in rows, the bristles in each row are staggered relative to bristles in adjacent rows, and the bristles have a pitch perpendicular to a brushing direction of the brush of between 5 mm and 8 mm, and a pitch parallel to the brushing direction of between 10 mm and 16 mm.

18. A brush comprising a carrier, a plurality of bristles and a frame, wherein the carrier is moulded to the bristles and the frame, wherein each bristle extends through a respective hole in the frame, wherein portions of the carrier at areas moulded to the bristles deform in response to pivoting of each bristle whereby each of the plurality of bristles is independently movable relative to the other bristles.

* * * * *